US010020571B2

(12) United States Patent
Hogg

(10) Patent No.: US 10,020,571 B2
(45) Date of Patent: Jul. 10, 2018

(54) ANTENNA MOUNTING SYSTEM FOR METALLIC STRUCTURES

(71) Applicant: ESSEX ELECTRONICS, INC., Carpinteria, CA (US)

(72) Inventor: Robert D. Hogg, Santa Barbara, CA (US)

(73) Assignee: ESSEX ELECTRONICS, INC., Carpinteria, CA (US)

( * ) Notice: Subject to any disclaimer, the term of this patent is extended or adjusted under 35 U.S.C. 154(b) by 271 days.

(21) Appl. No.: 14/248,707

(22) Filed: Apr. 9, 2014

(65) Prior Publication Data

US 2014/0300523 A1 Oct. 9, 2014

Related U.S. Application Data

(60) Provisional application No. 61/810,231, filed on Apr. 9, 2013.

(51) Int. Cl.

| | |
|---|---|
| ***H01Q 1/24*** | (2006.01) |
| ***H01Q 1/42*** | (2006.01) |
| ***H01Q 1/52*** | (2006.01) |
| ***H01Q 1/10*** | (2006.01) |

(52) U.S. Cl.

CPC ..... *H01Q 1/42* (2013.01); *H01Q 1/106* (2013.01); *H01Q 1/243* (2013.01); *H01Q 1/526* (2013.01)

(58) Field of Classification Search

CPC ..... H01Q 1/42; H01Q 1/526; H01Q 1/243

USPC ..... 343/789, 700 MS, 702, 893

See application file for complete search history.

(56) References Cited

U.S. PATENT DOCUMENTS

| | | | | |
|---|---|---|---|---|
| 5,589,842 | A * | 12/1996 | Wang | H01Q 1/38 343/700 MS |
| 5,914,693 | A * | 6/1999 | Takei | H01Q 13/16 343/700 MS |
| 6,181,281 | B1 * | 1/2001 | Desclos | H01Q 1/38 343/700 MS |
| 6,992,632 | B1 * | 1/2006 | Mohuchy | H01Q 9/065 343/700 MS |
| 7,277,060 | B2 * | 10/2007 | Fukuchi | H01Q 13/10 343/767 |
| 7,602,340 | B2 * | 10/2009 | Sato | H01Q 3/44 343/700 MS |
| 2007/0182626 | A1 * | 8/2007 | Samavati | G01S 19/36 342/357.57 |
| 2007/0200768 | A1 * | 8/2007 | Goldberger | H01L 25/165 343/700 MS |
| 2012/0268347 | A1 * | 10/2012 | Tatarnikov | H01Q 9/0464 343/893 |

* cited by examiner

*Primary Examiner* — Daniel J Munoz
*Assistant Examiner* — Hai Tran
(74) *Attorney, Agent, or Firm* — Glass & Associates; Kenneth D'Alessandro; Kenneth Glass

(57) ABSTRACT

An antenna mounting system includes a metal plate having a void formed therein and one or more continuous slots extending from the void to an edge of the metal plate. An antenna is mounted inside the void.

18 Claims, 1 Drawing Sheet

ANTENNA MOUNTING SYSTEM FOR METALLIC STRUCTURES

CROSS REFERENCE TO RELATED APPLICATIONS

This application claims the benefit of U.S. Provisional Application No. 61/810,231, filed Apr. 9, 2013, the disclosure of which is hereby incorporated in its entirety by reference.

BACKGROUND OF THE INVENTION

Radio frequency (RF) based systems are used for communicating with various types of access controls, logging systems, cashless payment systems as well as transferring data between units such as pictures between cameras in cell phones. The basis of these systems is the RF electronics unit and an antenna. The antenna generates a signal for communication with the card or other device. This antenna is typically a few inches on a side. Because of the small size relative to the operating frequency, these antennas are tuned with a matching network and the coil is a small number of turns of wire or turns on a printed circuit board.

A problem with using these antennas is that they need to be kept away from metal. Typical recommendations are that the antennas be kept at least four inches from a metal surface. Unfortunately, this is not practical for many systems and an alternate way of dealing with metal is needed. This is the object of the current invention.

There are ways of overcoming mounting issues which fall into the categories of nonmetal housings and ferrite shields. Some of the deficiencies of these approaches are that security requirements may make it difficult to employ them. A plastic housing and antenna mount is vulnerable to an attack which would render it useless. There is a similar problem with ferrite shields. The ferrite shields are placed behind the antenna and in front of the metal mounting surface. This then requires an additional nonmetallic cover over the antenna and it has the same issues as for the plastic cover. These limits may not be an issue in, for example, cell phone applications where the back cover of the phone protects the antenna but it is an issue in industrial and exterior applications.

The deleterious effect of the metal is that it carries electrical current generated from the antenna. This current loads the antenna and reduces or stops the radiation of the desired signal which needs to get to the device to be communicated with. The mechanism employed by the ferrite shielding is to divert the RF field away from the metal and thereby eliminate the generated currents in the metal. Since it is desirable to have the antenna in the plane of the metal surface or below it, an alternate approach is needed.

SUMMARY

The present invention stops the current from flowing through the metal plate by providing a slot from the center opening to the edge of the plate thus preventing the circulating currents which load the antenna. In this manner, the effect of the metal plate can be minimized almost completely.

Persons of ordinary skill in the art will realize that the following description of the present invention is illustrative only and not in any way limiting. Other embodiments of the invention will readily suggest themselves to such skilled persons.

With the structure as described, an appropriately shaped antenna can be placed in the opening and the antenna will perform well even in the presence of other metal. When there is a nonmetallic mounting structure, the antenna can be placed behind the plate and a rectangular antenna will perform well even behind the circular opening.

If a ferrite shielding box surrounds the sides and back of the antenna, the slotted metal plate will allow good performance of the antenna even with metal enclosures such as outlet boxes.

With the ferrite shielding, the antenna can be placed on a solid metal plate and then covered with the slotted metal plate. This provides good performance and excellent protection to the antenna since it is behind the metal.

BRIEF DESCRIPTION OF THE DRAWINGS

FIGS. 1 and 2 show non-limiting examples of such a plate including the slot. An antenna 26 is disposed in the void over the metal plate 22.

FIGS. 1 and 2 show non-limiting examples of such a plate including the slot. An antenna 26 is disposed in the enclosure 20 under the void in the metal plate 28. The void may be either larger, the same size, or smaller than the dimensions of the antenna.

Employing an antenna 26 having dimensions larger than the dimensions of the void further protects the system from tampering and intrusion.

Figure 1:
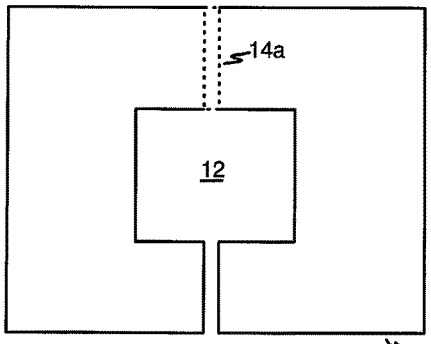
FIG. 1 is a diagram showing a metal plate 10 including a rectangular void 12 and having a slot 14 formed therein and running from the circular void to the edge of the plate according to one aspect of the present invention. In an alternate embodiment of the invention shown in FIG. 1, an additional slot 14*a* is shown in dashed lines. Persons of ordinary skill in the art will appreciate that one or more such additional slots 18*a* may be provided at various locations on the metal plate 10. Providing additional slots 14*a* will segment the metal plate 10. In embodiments having more than one slot, the segments of the metal plate 10 may be mounted on a non-conducting substrate to provide dimensional stability.
Figure 2:
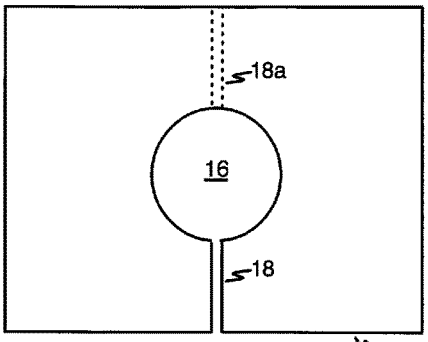
FIG. 2 is a diagram showing a metal plate 10 including a circular void 16 and having a slot 18 formed therein and running from the circular void to the edge of the plate according to another aspect of the present invention. The shape of the void is not critical to the functioning of the invention. In an alternate embodiment of the invention shown in FIG. 2, an additional slot 18*a* is shown in dashed lines. Persons of ordinary skill in the art will appreciate that one or more such additional slots 18*a* may be provided at various locations on the metal plate 10. Providing additional slots 18*a* will segment the metal plate 10. In embodiments having more than one slot, the segments of the metal plate 10 may be mounted on a non-conducting substrate to provide dimensional stability.
Figure 3:
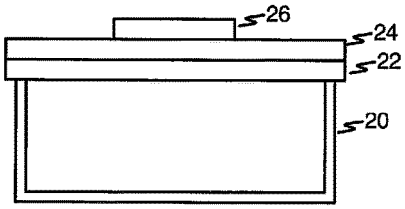
FIG. 3 is a diagram showing an illustrative and non-limiting embodiment of the current industry practices for mounting antennas on a metal plate in which enclosure or mounting box 20 is covered by solid metal plate 22. A ferrite shield 24 is disposed over the metal plate 22 and an antenna 26 is disposed over the ferrite shield.
Figure 6:
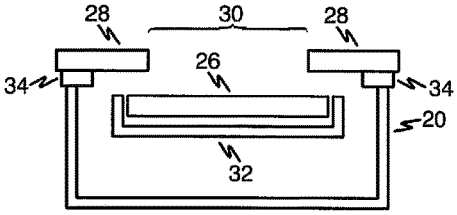

FIG. 6 is a diagram showing another illustrative and non-limiting embodiment of the invention in which a metallic or non-metallic mounting box or enclosure 20 is covered by a metal plate 28 including a void 30 with a slot running from the void 30 to the edge of the plate. FIGS. 1 and 2 show non-limiting examples of such a plate including the slot. An antenna 26 is disposed in the enclosure 20 under the void. A ferrite shield 32 is disposed between the antenna 26 and the back and side walls of the enclosure. Employing an antenna 26 having dimensions larger than the dimensions of the void further protects the system from tampering and intrusion.

Figure 4:
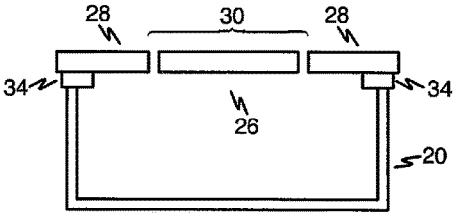
FIG. 4 is a diagram showing another illustrative and non-limiting embodiment of the invention in which a metallic or non-metallic mounting box or enclosure 20 is covered by metal plate 28 including a void 30 with a slot running from the void 30 to the edge of the plate.
Figure 5:
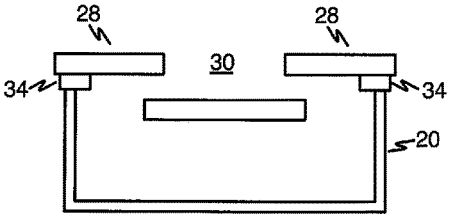
FIG. 5 is a diagram showing another illustrative and non-limiting embodiment of the invention in which a non-metallic mounting box or enclosure 20 is covered by is covered by a metal plate 28 including a void 30 with a slot running from the void 30 to the edge of the plate.

In the embodiments of FIGS. 4, 5, and 6 where the enclosure is formed from a metal, gasket 34 is disposed between the upper edges of the enclosure and the metal plate 28.

Figure 7:
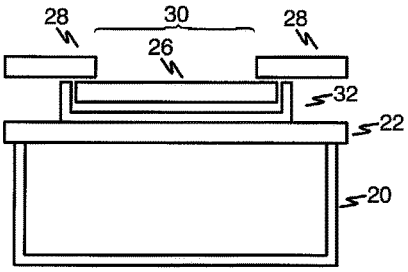

FIG. 7 is a diagram showing another illustrative and non-limiting embodiment of the invention in which a metallic or non-metallic mounting box or enclosure 20 is covered by a solid metal plate 22. A ferrite shield 32 is disposed over the solid metal plate 22 and an antenna 26 is disposed over the ferrite shield. A metal plate 28 including a void 30 with a slot running from the void 30 to the edge of the plate is disposed over the antenna 26. Employing an antenna 26 having dimensions larger than the dimensions of the void further protects the system from tampering and intrusion.

The various illustrative non-limiting embodiments of the invention shown herein have been disclosed in connection with an enclosure or mounting box. Persons of ordinary skill in the art will appreciate that an enclosure is not necessary for practicing the invention. Actually, a plastic enclosure is the same as no enclosure. The assembly could simply be fastened to a wall without employing a mounting box or enclosure. In other embodiments, the assembly could be built into a piece of equipment without a separate enclosure for the antenna.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

The invention claimed is:

1. An antenna mounting system comprising:

an enclosure having an opening;

an antenna;

a metal plate mounted over the opening of the enclosure, the metal plate defining a plane and having a void formed therein, the void surrounding the antenna and separating the antenna from the metal plate, the metal plate having a slot extending from an inner edge of the metal plate defining the void to a first edge of an outer periphery of the metal plate, the slot preventing the metal plate from being a radiator; and a ferrite shield covering a surface of the antenna facing a rear wall of the enclosure.

2. The antenna mounting system of claim 1 further including a non-conductive antenna cover over an upper surface of the metal plate.

3. The antenna mounting system of claim 1 wherein the enclosure is formed from a metal.

4. The antenna mounting system of claim 3 further comprising a non-conductive gasket disposed between an upper edge of the enclosure and the metal plate.

5. The antenna mounting system of claim 1 wherein the enclosure is formed from a non-conductive material.

6. The antenna mounting system of claim 1 wherein the antenna is mounted behind the plane of the metal plate and separated from the metal plate.

7. The antenna mounting system of claim 6 further including a non-conductive antenna cover over an upper surface of the metal plate.

8. The antenna mounting system of claim 6 wherein linear dimensions in x and y directions of the void are larger than linear dimensions in x and y directions of the antenna.

9. The antenna mounting system of claim 6 wherein linear dimensions in x and y directions of the void are smaller than linear dimensions in x and y directions of the antenna.

10. The antenna mounting system of claim 6 wherein linear dimensions in x and y directions of the void are essentially the same as linear dimensions in x and y directions of the antenna.

11. The antenna mounting system of claim 1 wherein the enclosure is formed from a metal.

12. The antenna mounting system of claim 11 further comprising a non-conductive gasket disposed between an upper edge of the enclosure and the metal plate.

13. The antenna mounting system of claim 1 wherein the enclosure is formed from a non-conductive material.

14. The antenna mounting system of claim 1 wherein side edges of the ferrite shield extend around side edges of the antenna.

15. An antenna mounting system comprising:

an enclosure having an opening;

a solid metal plate;

a ferrite shield mounted on the solid metal plate;

an antenna mounted on the ferrite shield; and a metal plate mounted over and separated from the antenna, the metal plate having a void formed therein centered over the antenna, the metal plate having a slot extending from an inner edge of the metal plate defining the void to a first edge of an outer periphery of the metal plate, the slot preventing the metal plate from being a radiator;

wherein the solid metal plate is mounted over the opening of the enclosure, the ferrite shield, the metal plate, and the antenna are mounted on the solid metal plate.

16. The antenna mounting system of claim 15 wherein linear dimensions in x and y directions of the void are smaller than linear dimensions in x and y directions of the antenna.

17. The antenna mounting system of claim 15 wherein linear dimensions of the void in x and y directions are essentially the same as linear dimensions in x and y directions of the antenna.

18. The antenna mounting system of claim 15 wherein side edges of the ferrite shield extend around side edges of the antenna.

* * * * *